US006072276A

United States Patent [19]

Okajima

[11] Patent Number: 6,072,276

[45] Date of Patent: Jun. 6, 2000

[54] COLOR PLASMA DISPLAY PANEL AND METHOD OF MANUFACTURING THE SAME

[75] Inventor: Tetsuji Okajima, Tokyo, Japan

[73] Assignee: NEC Corporation, Tokyo, Japan

[21] Appl. No.: 08/879,235

[22] Filed: Jun. 19, 1997

[30] Foreign Application Priority Data

Jun. 21, 1996 [JP] Japan ..... 8-162201
Dec. 2, 1996 [JP] Japan ..... 8-322024

[51] Int. Cl.[7] ..... H01J 5/16

[52] U.S. Cl. ..... 313/581; 313/112

[58] Field of Search ..... 313/581, 582, 313/584, 586, 112, 587

[56] References Cited

U.S. PATENT DOCUMENTS 5,541,479 7/1996 Nagakubo ..... 313/584 X
5,838,105 11/1998 Mitomo ..... 313/112 X

FOREIGN PATENT DOCUMENTS 0762462 3/1997 European Pat. Off. .
4-249032 9/1992 Japan .

OTHER PUBLICATIONS

Patent Abstracts of Japan; vol. 016, No. 215 (E–1204), May 20, 1992 & JP 04 036930 A (Fujitsu Ltd), Feb. 6, 1992, Abstract.
Patent Abstracts of Japan; vol. 095, No. 004, May 31, 1995 & JP 07 021924 A (NEC Corp), Jan. 24, 1995, Abstract.

*Primary Examiner*—Ashok Patel
*Attorney, Agent, or Firm*—Sughrue, Mion, Zinn Macpeak & Seas, PLLC

[57] ABSTRACT

In an AC type plasma display panel in which a discharge electrode and an dielectric material layer are formed on its substrate on the display surface, it has a structure in which a thin color filter layer containing fine inorganic pigment particles as its main component is formed in contact with or within the dielectric material layer. The color filter layer containing the fine pigment particles as its main component can have good performance by arranging that the color filter layer has a thickness of 0.5 through 5 microns, and the fine pigment particles have average particle size of 0.01–0.15 microns.

18 Claims, 15 Drawing Sheets

COLOR PLASMA DISPLAY PANEL AND METHOD OF MANUFACTURING THE SAME

BACKGROUND OF THE INVENTION

1. Field of the Invention

The present invention relates to a color plasma display panel used for an information display terminal, a flat panel TV receiver or the like, and, more particularly, to a panel structure for attaining high contrast, high brightness and high efficiency for light emission.

2. Description of the Related Art

A color plasma display panel is a display which excites phosphor with ultraviolet rays generated by gas discharge, thereby causing the phosphor to emit light for display. It can be classified into an AC type and a DC type depending on the form of discharge. Of them, the AC type is superior to the DC type with its brightness, luminous efficiency, and life. Of the AC type, a direct view type AC surface discharging type is superior with its brightness and luminous efficiency.

FIG. 14 is a sectional view of an example of a conventional direct view type AC surface discharging color plasma display panel. A transparent electrode 2 is formed on a front substrate 1 which is a transparent glass plate constituting the display surface. The transparent electrode is formed in a plurality of stripes in a direction parallel to the surface of paper sheet. Pulse AC voltage from several tens to several hundreds KHz is applied between the adjacent transparent electrodes 2 to obtain display discharge.

Tin oxide ($SnO_2$) or indium tin oxide (ITO) is used for the transparent electrode 2. Employed to lower resistance is an electrode provided therealong a bus electrode made of a multilayer thin film of chromium/copper/chromium, a metal thin film such as an aluminum thin film, or a metal thick film of silver or the like. When it is formed by a silver thick film, slight amount of black pigment is often mixed. However, the bus electrode is omitted in FIG. 14.

The transparent electrode 2 is coated with a transparent insulating layer 17. The transparent insulating layer 17 has a function for limiting current which is unique to the AC type plasma display. In view of dielectric breakdown voltage or ease of manufacturing, the transparent insulating layer 17 is typically formed by applying paste containing low melting point lead glass, firing and reflowing it at a raised temperature higher than its softening point. This provides a flat transparent insulating layer 17 not containing an air bubble therein and with a thickness of about 20 microns to 40 microns. A black matrix layer 30 is formed thereon. This serves to reduce reflection of external light on the display surface, and has an effect of reducing erroneous discharge and optical crosstalk between adjacent discharge cells. The black matrix 30 is also typically formed by applying paste consisting of metal oxide powder such as chromium or nickel and low melting point lead glass with thick film printing.

Then, a protective layer 16 is formed to coat the entire structure of the transparent insulating layer 17 and the black matrix layer 30. It is a thin film of MgO formed by vapor deposition or spattering, or a thick film of MgO formed by printing or spraying. It has a thickness of about 0.5 microns to 2 microns. The protective layer serves to reduce the discharge voltage and to prevent surface spattering.

On the other hand, formed on a rear substrate 8 which is a glass plate is a data electrode 9 for writing display data. In FIG. 14, the data electrode 9 extends in a direction perpendicular to the sheet surface, and formed for each of discharge cells 18–20. That is, the data electrode 9 is orthogonal to the transparent electrode 2 formed on the front substrate 1 which is a glass plate. The data electrode 9 is coated with a white insulating layer 7 which is formed by printing and firing thick film paste, comprising a mixture of low melting point lead glass and white pigments. Typically, titanium oxide powder or alumina powder is used as the white pigment. A white partition 6 is typically formed on the white insulating layer 7 through thick film printing or sand blasting. Then, phosphor (red) 10, phosphor (green) 11, and phosphor (blue) 12 are applied on the discharge cells 18, 19 and 20, respectively. Each phosphor is also applied on sides of the white partition 6 to increase the area on which the phosphor is applied and to obtain high brightness. Typically, screen printing is used for formation of each phosphor film.

The front substrate 1 is lined and air-tightly sealed to the rear substrate 8 so that the pattern of black matrix layer 30 formed on the front substrate 1 overlaps the white partition 6 formed on the rear substrate 8, Dischargeable gas such as a mixture of He, Ne and Xe is sealed in each discharge cell 18–20 under a pressure of about 500 torr.

In FIG. 14, each of discharge cells 18–20 is arranged with two transparent electrodes 2 between which surface discharge occurs to produce plasmas in the discharge cell (red) 18, discharge cell (green) 19 and discharge cell (blue) 20. Ultraviolet rays generated at that moment excite the phosphor (red) 10, phosphor (green) 11 and phosphor (blue) 12, causes them to emit visible light, thereby obtaining emission for display through the front substrate 1.

A set of adjacent transparent electrodes 2 generating surface discharge serves as a scan electrode and a sustain electrode, respectively. In actually driving the panel, a sustain pulse is applied between the scan electrode and the sustain electrode. When write discharge is to be generated, opposing discharge is generated by applying a voltage between the scan electrode and the data electrode 9. Such discharge is maintained by the sustain pulse subsequently applied to write pulse between the surface discharge electrodes.

FIG. 5 shows another conventional example. It is a one in which the black matrix 30 of FIG. 14 is increased for its film thickness to form a black partition 5. The basic process is same as that in FIG. 14. The black partition 5 is typically formed with screen printing or sand blasting. Materials used are low melting point lead glass, a filler material such as alumina, and a black pigment. The black pigment used is a one similar to that for the black matrix 30. This structure has a smaller area of applied phosphor than that of the structure of FIG. 14 so that its brightness is slightly reduced. However, since some distance can be maintained for the phosphor at the top of the white partition 6 from the surface discharge generated along the front substrate 1, there is an advantage that there is small variation in brightness even after lighting for a prolonged period of time.

The phosphor used for the color plasma display panel is white powder with very high reflectance. In the conventional color plasma display panel as described for FIG. 14 or 15, when light in a room or outdoor (external light) is incident on the panel, the external light is absorbed by the black matrix or black partition, or the bus electrode, but about 30%–50% is reflected so that contrast or color purity is significantly degraded. Thus, while there is an approach to arrange an ND filter with transmissivity of about 40–80% on the panel surface, it has a disadvantage that brightness of the panel is reduced because it also absorbs the emission from the panel.

There is an approach to use micro-color filters so that the panel brightness is not reduced as possible, and the reflection of external light is reduced. This is an approach to provide color filters for transmitting red, green and blue light on the display surface in correspondence to color emitted from respective discharge cells of red, green and blue. The micro-color filter for the plasma display is formed by a method for directly forming it on the surface of glass substrate, or a method for constituting the insulating layer of the AC plasma display with a tinted glass layer. FIG. 15 shows a sectional view of an example of conventional color plasma display panel using the latter method. This forms color filters transmitting color emitted from a discharge cell (red) 18, a discharge cell (green) 19 and a discharge cell (blue) 20 on the transparent electrode 2. The structural difference from FIG. 14 lies in that the transparent insulating layers 17 coating the discharge electrodes are replaced by a color filter (red) 13, a color filter (green) 14 and a color filter (blue) 15 which are constituted by tinted low melting point lead glass layers. This structure is known from Japanese Laid-Open Patent Publication Hei. 4-36930. This enables it to suppress attenuation of light emitted from each discharge cell 18–20 at the minimum level, to suppress reflection of external light, and to improve contrast.

Each of the color filters 13–15 is formed as an insulating layer of tinted low melting point lead glass generally by mixing low melting point lead glass powder and pigment powder and printing filter paste which is mixture of organic solvent and binder for each color with screen printing, and firing it. Here, since pigment powder should withstand against the firing process at a high temperature (500° C.–600° C.), inorganic materials are selected. Typical pigment powder is:

Red: $Fe_2O_3$ type

Green: $CoO—Al_2O_3—TiO_2—Cr_2O_3$ type

Blue: $CoO—Al_2O_3$ type,

The filter paste is separately printed in three passes for each color of red, green and blue to form the entire color filter layer.

FIG. 6 shows a case where, in a similar structure, a black partition 5 is formed instead of the black matrix 30.

The color filter layer is necessary to have a thickness of 20 microns or more so that it can also serve as an insulating layer with sufficient dielectric breakdown voltage. This causes a recess or raise at the joint of each color of the color filters. It adversely affects dielectric breakdown or the post process for black matrix or black partition.

To avoid such adverse effect, known from Japanese Laid-Open Patent Publication Hei. 7-21924 is a method which flattens the entire surface of the color filter by further coating the low melting point tinted lead glass color filters 13–15 with a transparent insulating layer 4 as shown in FIG. 7. In addition, to attain the structure of FIG. 15 or 6, Japanese Laid-Open Patent Publication Hei. 4-249032 discloses a method in which low melting point lead glass paste is applied on the entire surface after each color pigment is separately painted and arranged for diffusing and dispersing the pigment in the low melting point lead glass layer.

The conventional color filter layer constituted by dispersing pigment powder in the low melting point lead glass causes scattering of light because the refraction index differs between the pigment and, the low melting point lead glass. This leads to a disadvantage in that parallel ray transmittance is deteriorated for the filter. Here, the parallel ray transmittance means transmittance of light substantially linearly transmitting through the filter, and does not include components of light scattered by the filter. As such, since the color filter has high scattering characteristics, the external light is back scattered, which deteriorates the effect as the color filter. That is, it causes opaque screen display. In addition, since the color of the color filter itself is further emphasized, there is a disadvantage that a feeling of disorder occurs particularly in displaying black. In addition, there is a problem that the color emitted from the discharge cell is reduced to lower brightness. Furthermore, the pigment is not often uniformly dispersed in the low melting point lead glass film, but aggregated therein, so that the performance as the color filter may be extremely degraded. Moreover, when a pigment is dispersed in the low melting point lead glass, there may be a problem that the pigment suffers from discoloring or change of color.

Furthermore, thorough experiments revealed that the pigment might cause the transparent electrode consisting of an ITO or Nesa ($SnO_2$) film to react with the pigment when fired at a high temperature so that the performance of color filter may be deteriorated. For example, for a $CoO—Al_2O_3$ type pigment which is excellent as a blue pigment, there is a problem that light is absorbed near a wavelength of 400 nm through the firing process to significantly reduce transmittance as the blue filter, thereby causing reduction of panel brightness and destruction of color balance. In addition, the red filter paste using an $Fe_2O_3$ type pigment has a problem that significant discoloring is caused by reaction with the transparent electrode, whereby the function of color filter is impaired. Such phenomenon are not clear whether they are caused from direct reaction or catalysis of the transparent electrode material, but problems to be solved to realize good color filters.

In addition to the deterioration of color filter performance as described above, since the arrangement for dispersing the color pigment in the low melting point lead glass accompanies reflow due to firing, there arise such a problem that the fine color filter pattern is offset or spread into an area surrounding a predetermined pixel.

These problems prevent a color plasma display panel with excellent display performance having good color filters from being put in practical use.

SUMMARY OF THE INVENTION

Therefore, a major object of the present invention is to reduce a feeling of disorder such as a feeling of opaqueness by enhancing parallel ray transmittance of color filter, to prevent change of transmission spectrum due to reaction between pigment powder and a transparent electrode material, or between pigment powder and low melting point lead glass, and to attain a color filter with good characteristics.

An AC type color plasma display panel according to the present invention comprises transparent electrodes coated by an insulating layer, the insulating layer having at least a two-layer structure in which a buffer layer directly coating the transparent electrodes and an insulating layer with a function as a color filter are laminated.

In the AC type color plasma display panel according to the present invention, the buffer layer consists of low melting point lead glass, alumina, or silicon dioxide.

In the AC type color plasma display panel according to the present invention, the transparent electrode consists of a tin oxide or ITO.

In the AC type color plasma display panel according to the present invention, the insulating layer with a function as a color filter is formed by printing a mixture mixing low melting point lead glass and pigment powder.

In the AC type color plasma display panel according to the present invention, the insulating layer with a function as a color filter is formed by first printing and firing pigment powder, and then by coating and firing transparent low melting point lead glass thereon.

In the AC type color plasma display panel according to the present invention, the insulating layer with a function as a color filter is formed by pattern forming a mixture mixing pigment powder and a photosensitive material with photolithography, and then by coating and firing transparent low melting point lead glass thereon.

An AC type color plasma display panel according to the present invention comprises at least discharge electrodes and an insulating layer on a front surface which serves a display surface, wherein a thin color filter layer is formed in contact with or within the insulating layer, the color filter layer containing fine pigment particles as its main component.

In the AC type color plasma display panel according to the present invention, a thin color filter layer is formed on the insulating layer, the color filter layer containing fine pigment particles as its main component.

In the AC type color plasma display panel according to the present invention, after the thin color filter layer is formed on the substrate containing the discharge electrodes, the insulating layer is formed to coat the color filter layer, the color filter layer containing fine pigment particles as its main component.

In the AC type color plasma display panel according to the present invention, after the insulating layer is formed on the substrate containing the discharge electrodes, the thin color filter layer is formed, the color filter layer containing fine pigment particles as its main component, the insulating layer being formed to coat the color filter layer.

In the AC type color plasma display panel according to the present invention, the insulating layer consists of at least two layers of insulating layer constituting materials, the softening point of the insulating layer constituting material contacting at least one surface of the thin color filter layer containing fine pigment particles as its main component being higher than the softening point of the constituting material in at least one layer in the other insulating layer constituting material.

In the AC type color plasma display panel according to the present invention, the thin color filter layer containing fine pigment particles as its main component has a thickness of 0.5–5 microns.

In the AC type color plasma display panel according to the present invention, the thin color filter layer containing fine pigment particles as its main component has a thickness of 0.5–3 microns.

In the AC type color plasma display panel according to the present invention, the thin color filter layer containing fine pigment particles as its main component is made of pigment powder the average particle size of which is 0.01–0.15 microns.

A method for manufacturing a color plasma display panel according to the present invention wherein the insulating layer consists of at least two layers, comprising at least two firing steps, wherein a first firing step is for firing the insulating layer directly coating the color filter layer from the above at a temperature not adversely affecting the color filter layer, a second firing step for performed to fire at least one of other layers at a temperature higher than that in the first firing step.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE PREFERRED EMBODIMENTS

[First Embodiment]

Figure 8:
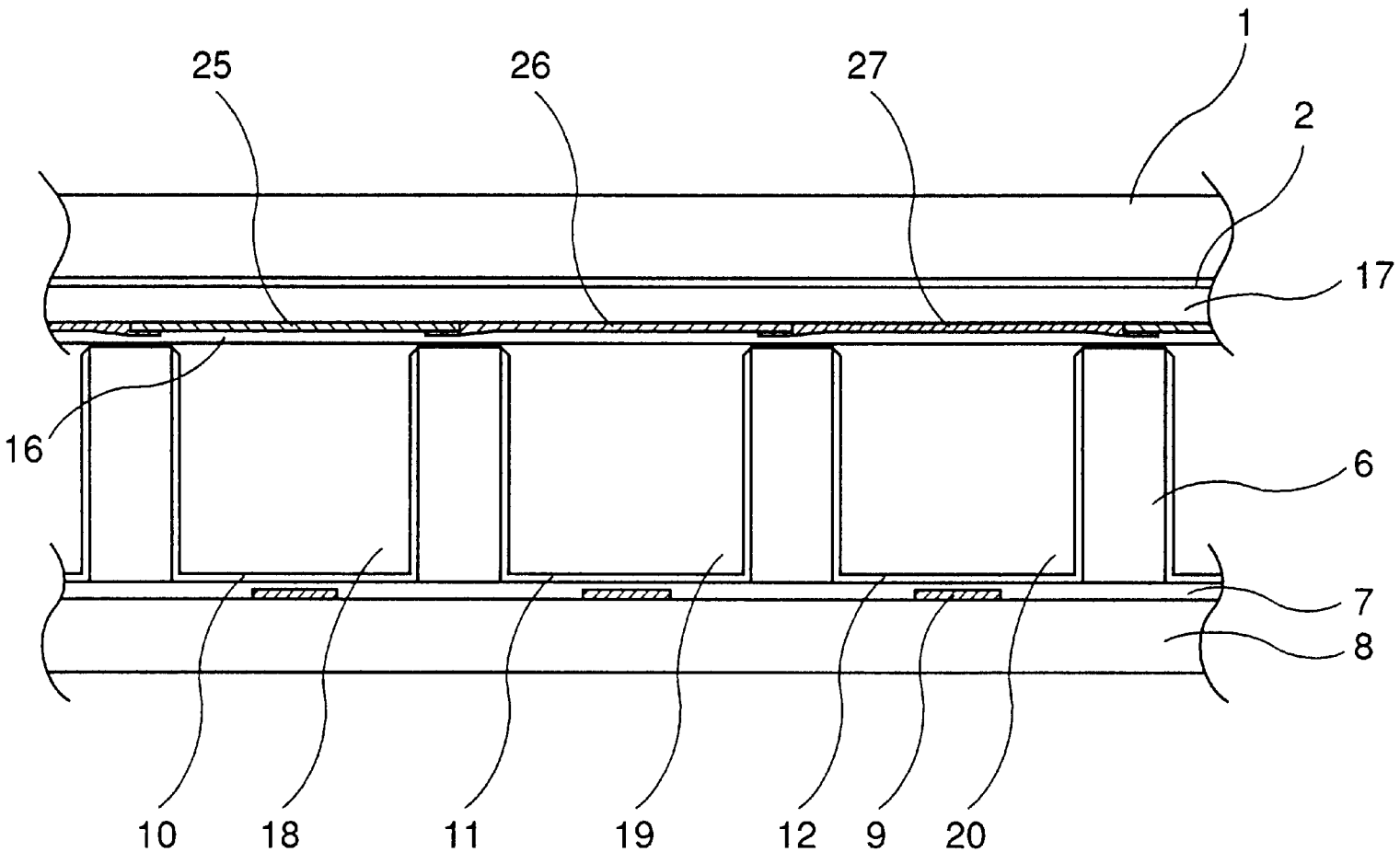
FIG. 8 is a sectional view of the panel structure of a color plasma display panel according to a first embodiment of the present invention.
Figure 14:
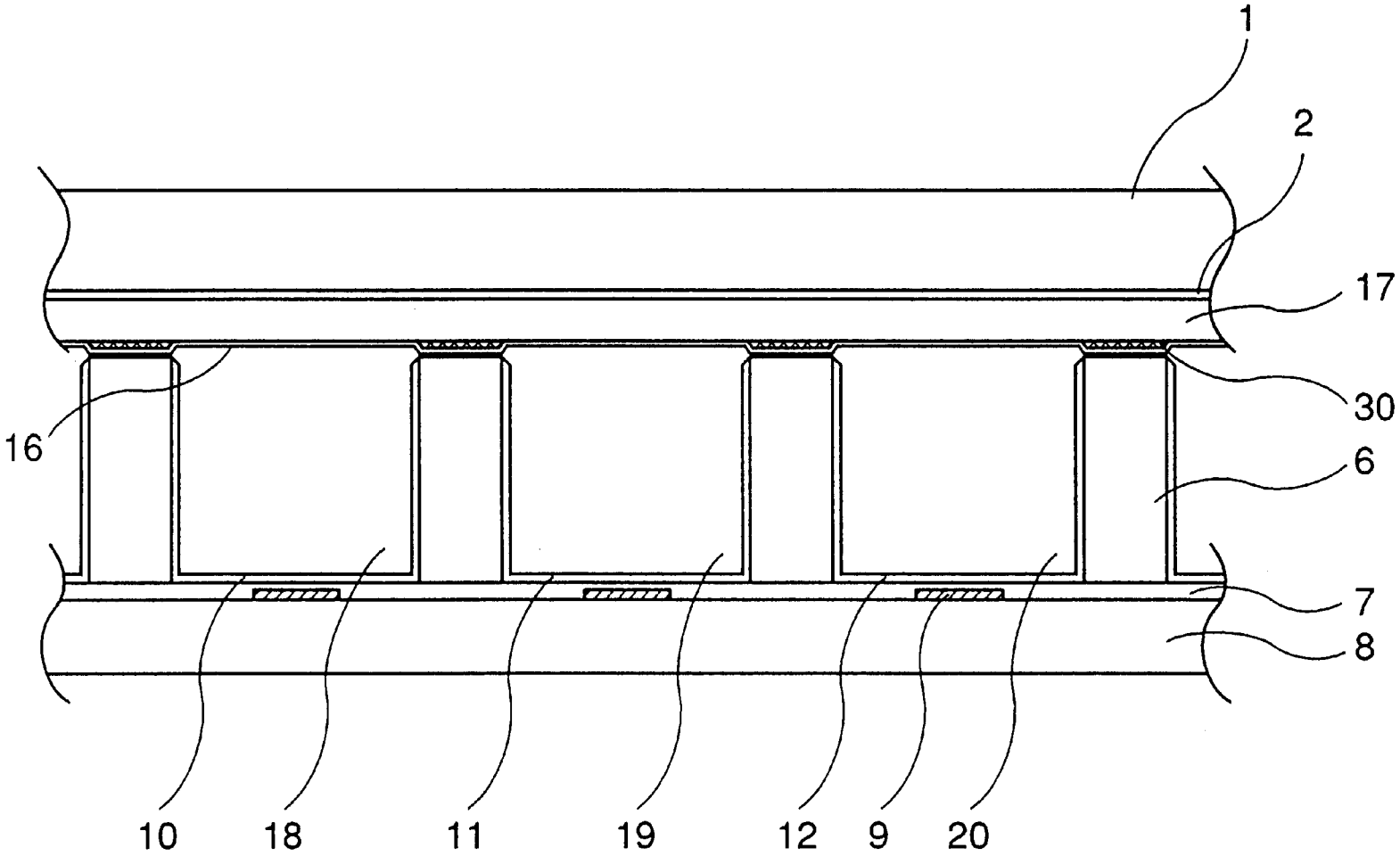
Fig.14 PRIOR ART
FIG. 14 is a sectional view of a conventional color plasma display panel.
Figure 15:
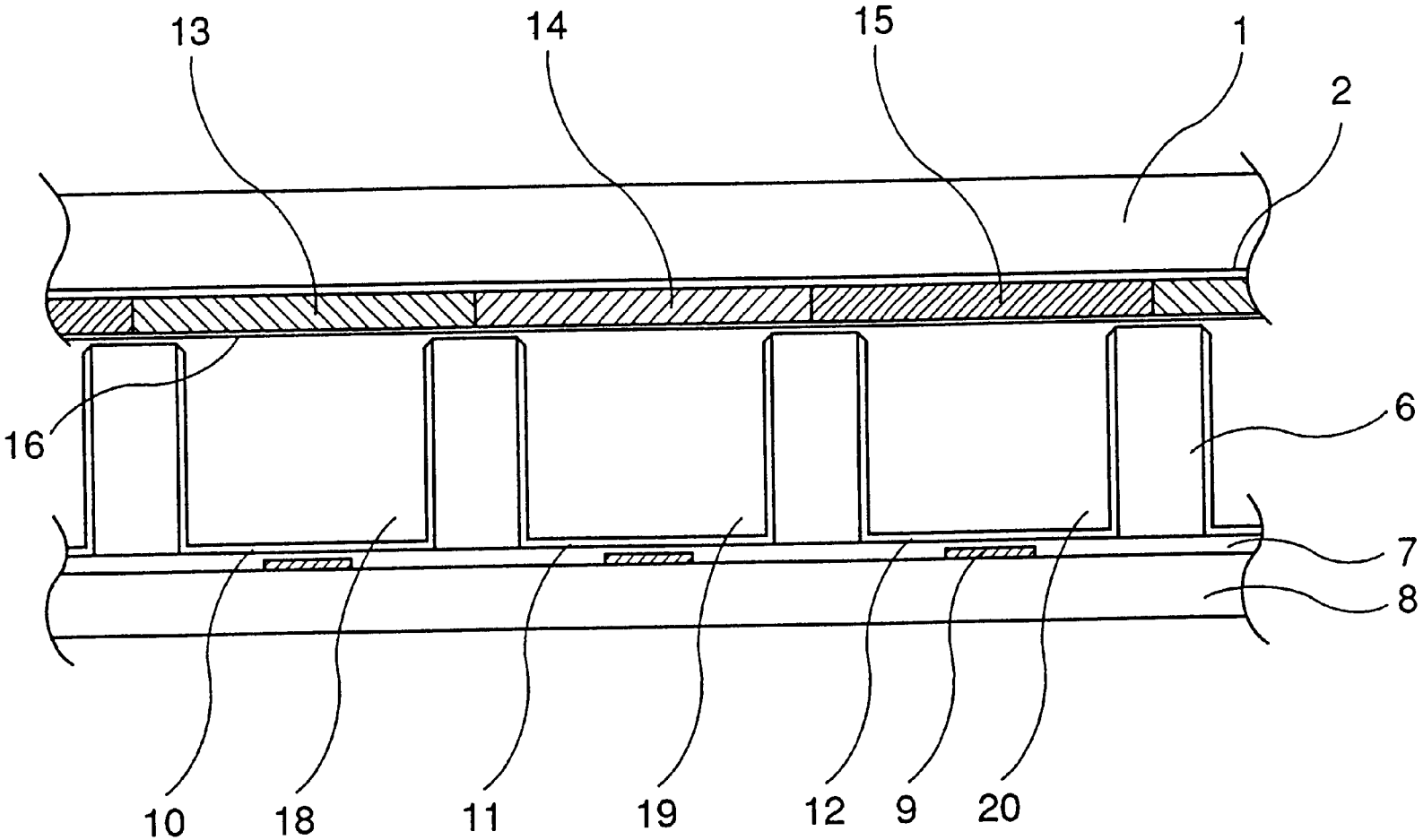
Fig.15 PRIOR ART
FIG. 15 is a sectional view of a conventional color plasma display panel.

FIG. 8 shows in section the structure of the color plasma display panel according to an embodiment of a first invention, which will be explained. Its rear substrate is exactly same as that shown in FIG. 14 in connection with the prior art. Sequentially formed on the rear substrate 8 are data electrodes 9, white partitions 6, a phosphor (red) 10, a phosphor (green) 11, and a phosphor (blue) 12 to form spaces which serve as discharge cells 18, 19 and 20 for the respective color. The white partition 6 are arranged with a pitch of, for example, 350 microns. Each white partition 6 has a width of about 80 microns. Formed on the front substrate 1 are the transparent electrodes 2 and a metal bus electrode (not shown) to reduce resistance. Then, paste of low melting point glass is screen printed and fired at a temperature of about 580° C. to form a transparent insulating layer 17 consisting of a molten glass layer with a thickness of about 25 microns. The color filter for each color is formed on the substrate in the following process. Paste prepared by mixing a red fine particle pigment containing iron oxide as its main component in binder and solvent is screen printed in stripes in a pitch of 1.05 mm and with a width of about 390 microns, and dried by evaporating the solvent at about 150° C. Subsequently, screen printing is adjacently performed and dried at a position parallel shifted by 350 microns from the already printed red pigment pattern by using paste in which a green fine particle pigment containing oxides of cobalt, chromium, aluminum and titanium as its main components is mixed in binder and solvent. Finally, printing is performed and dried in a similar manner by using paste which consists of a blue pigment containing fine particles of oxides of cobalt and aluminum as its main component, binder and solvent. After the entire area corresponding to the display section is coated by the pigment of each color through printing of these three fine color pigment particles, it is fired at about 520° C. This process forms the fine pigment particle layer (red) 25, the fine pigment particle layer (green) 26, and the fine pigment particle layer (blue) 26.

The transparent insulating layer 17 of low melting point lead glass is fired at a high temperature enough to melt the low melting point lead glass so that a flat, transparent insulating layer free from inner air bubble can be obtained. On the other hand, firing of the fine pigment particle layer on the insulating layer is conducted at a temperature selected not to reflow the low melting point lead glass so much. If the temperature is raised, it reflows the underlying insulating layer of low melting point lead glass. Thus, there arises such a problem that the pattern of the pigment layer printed in a good state is deformed or cracked, or that the performance of the color filter is deteriorated as scattering characteristics is intensified because the low melting point lead glass and the fine pigment particle layer diffuse each other, or as transmission spectrum is changed because of reaction with the low melting point lead glass. Therefore, to attain the thin color filter layer according to the present invention containing fine pigment particles as its main component, the temperature is selected to be a temperature higher than one sufficiently decomposing and firing the binder components contained in the pigment paste, but a temperature lower than a one little reflowing the insulating layer. According to the embodiment, the firing temperature is selected to be 520° C. higher than the softening point of the low melting point lead glass used for the insulating layer by about 10° C. This temperature does not cause flowing or diffusion deforming the pattern on the fine pigment particle layer, but slightly softens the surface of the insulating layer, so that there is an advantage that the fine pigment particle layer is firmly attached. The color filter layer after firing is arranged to have a thickness of about one to two microns. Of course, since the fine pigment particle itself is not melted at this temperature, there is no possibility that the pattern is disordered due to reflow as in the conventional color filter.

Then, the front substrate is completed by vacuum depositing a protective layer 16 of an MgO film directly on the color filter. Since the fine inorganic particle used had a very fine particle size of about 0.01 to 0.15 microns, and constitutes a dense layer, the MgO film does not peel off even if it is directly vacuum deposited. Finally, it is assembled with a rear substrate to complete a plasma display panel with color filter through sealing, evacuation, and filling of discharge gas.

For a plasma display panel with a large area, the screen printing may not have sufficient accuracy. In such a case, if a gap occurs between patterns of adjacent fine pigment particle layers, the display surface becomes significantly uneven, and is degraded for its quality, so that, in the embodiment, a fine pigment particle layer of a color is arranged to overlap an adjacent fine pigment particle layer of other colors by 40 microns. Since this overlap region is positioned on the partition from which no light is emitted, not only overlapping does not cause any inconvenience, but it constitutes a highly tinted black matrix, whereby it contributes to improvement of contrast under external light. Of course, the fine pigment particle layers of respective colors may be formed without overlapping for the convenience of manufacturing.

Since, in the plasma display panel of the embodiment, the color filter layer is not diffused in the insulating layer of low melting point lead glass, there is no deterioration due to reaction with the low melting point lead glass, or scattering. In addition, since it is a thin layer containing fine pigment particles with very fine particle size as its main component, it is possible to obtain a good color filter characteristics with high parallel ray transmittance.

[Second Embodiment]

Figure 9:
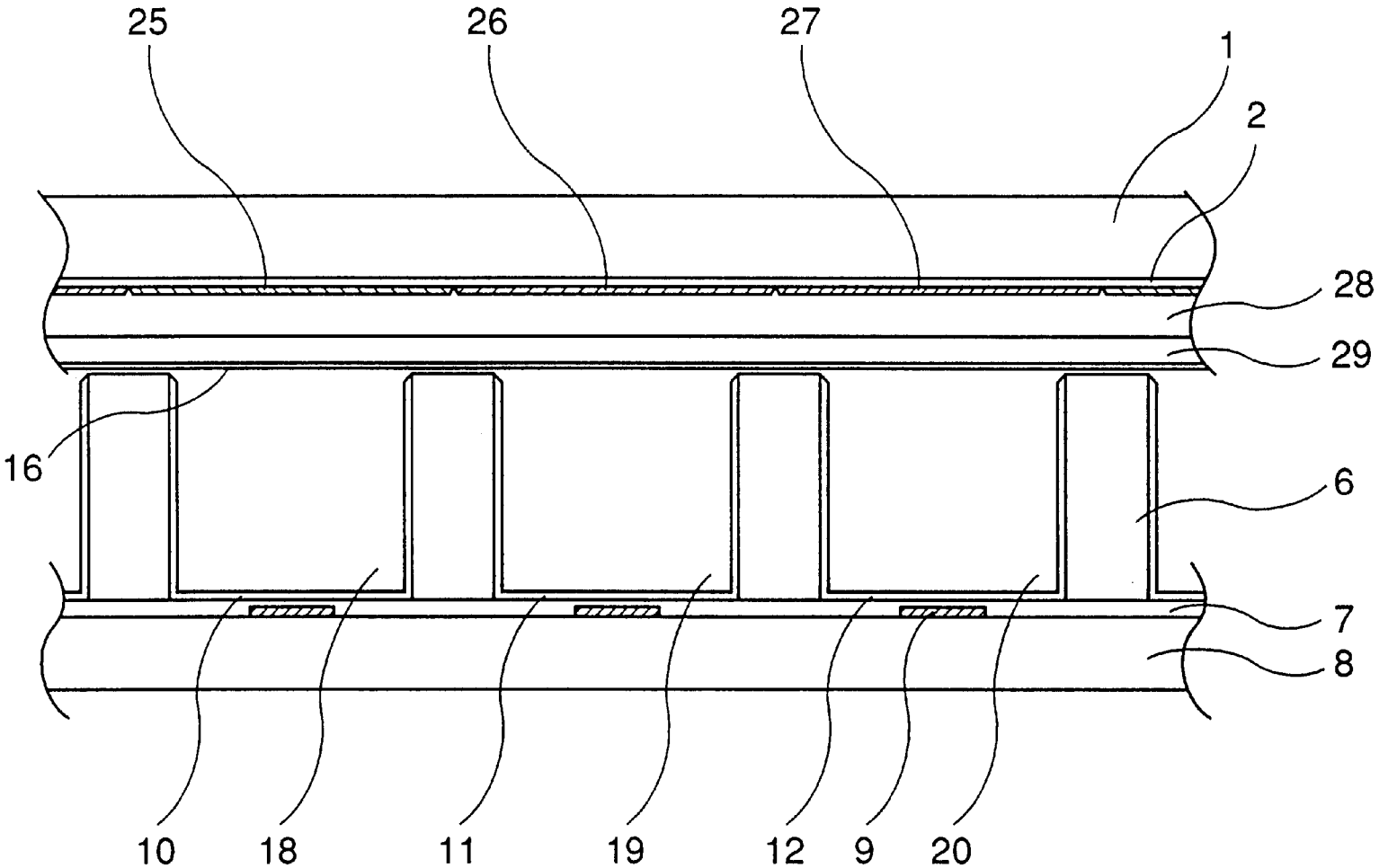
FIG. 9 is a sectional view of the panel structure of a color plasma display panel according to a second embodiment of the present invention.

The above-mentioned structure has a problem that the color filter layer peels off when it contacts the rear substrate during assembly because the color filter layer consisting of fine pigment particles does not have high mechanical strength. In addition, it is difficult to form the black matrix layer or the like after formation of the color filter. Thus, as a second embodiment, FIG. 9 shows a case where a color filter layer is formed before the transparent insulating layer is formed, which is described in the following. After transparent electrodes 2 and a metal bus electrode (not shown) are formed on a front substrate 1, respective color filter layers are formed in a manner similar to the first embodiment. Screen printing is performed and dried in stripes with a pitch of 1.05 mm and a width of about 340 microns by using paste which is prepared by mixing a red pigment of fine particles containing iron oxide as its main component with binder and solvent. Subsequently, screen printing is adjacently performed and dried at a position parallel shifted by 350 microns from the already printed red pigment pattern by using paste in which a green fine particle pigment containing oxides of cobalt, chromium, aluminum and titanium as its main components is mixed in binder and solvent. Finally, printing is performed and dried in a similar manner by using paste which consists of a blue pigment containing fine particles of oxides of cobalt and aluminum as its main component, binder and solvent. Then, firing is performed for removing the binder so that the pigment is firmly attached. With these three printing of color pigments, the entire area corresponding to the display section is coated with red, green and blue fine pigment particle layers 25, 26 and 27 with a thickness of about 2 microns. A first insulating layer 28 is formed by screen printing, drying and firing paste of low melting point lead glass on this substrate. In addition, another paste of low melting point lead glass is applied, dried and fired again on the first insulating layer 28 to form a second insulating layer 29.

Particular attention is paid in forming the first and second insulating layers consisting of low melting point lead glass on the fine pigment particle layer. That is, if the firing temperature for the low melting point lead glass is high, the fine pigment particles are diffused into the glass layer during firing, or the pattern on the pigment layer is disordered by reflow of the glass layer. Even if the glass layer does not significantly flow, cracks may be generated in the color filter layer. Although very fine cracks provide no substantial effect, cracks as large as 50 microns may be generated. Since the portions with cracks are transparent, they significantly degrade the function of filter. Tendency of crack generation depends on the pigment material and particle size. It is particularly significant in the green pigment or a very fine particle pigment with particle size of 0.01 microns or less.

According to the embodiment, the insulating layer of low melting point lead glass is structured in two layers to overcome such a problem. That is, used for the first insulating layer 28 directly coating the fine pigment particle layers 25–27 is powder of low melting point glass with a softening point higher than that for the second insulating layer 29. In the embodiment, paste consisting of glass powder with a softening point of 520° C. as the raw material is applied on the fine pigment particle layer, and fired at 535° C. after drying to form the first insulating layer 28 as thin as about 7 microns so as to coat the fine pigment particle layer. In this process, since there is a small difference between the firing temperature and the softening point temperature for the first insulating layer, fluidity is low for the low melting point lead glass in firing, so that it does not cause adverse effects on the fine pigment particle layer such as cracks, aggregation, or dispersion or diffusion into the glass layer. However, since the firing temperature is low, the first insulating layer 28 has poor flatness, and has slight waviness. In addition, there remains minute pinholes. Thus, it has poor dielectric strength as an insulating layer. Then, after the first insulating layer 28 is formed, the second insulating layer 29 is formed by printing, drying and firing paste consisting of low melting point glass with lower softening point. The firing temperature is selected to be a temperature causing reflow for providing an insulating layer with high dielectric strength without pinhole or air bubble. The embodiment uses a low melting point glass material with a softening point of 490° C., and conducts firing at 570° C. Since the fine pigment particle layer destined to be the color filter layer has been already coated with the first insulating layer 28 with a high softening point, diffusion of pigment or the like is not caused even in firing of the second insulating layer 29, so that it maintains a good shape as a thin pigment layer. In addition, there is no deformation of or cracks in the pigment pattern due to flowing.

Finally, a protective layer 16 of an MgO film is vapor deposited to complete the front substrate. A plasma display panel is completed by assembling it with a rear substrate, and filling discharge gas.

[Third Embodiment]

Figure 10:
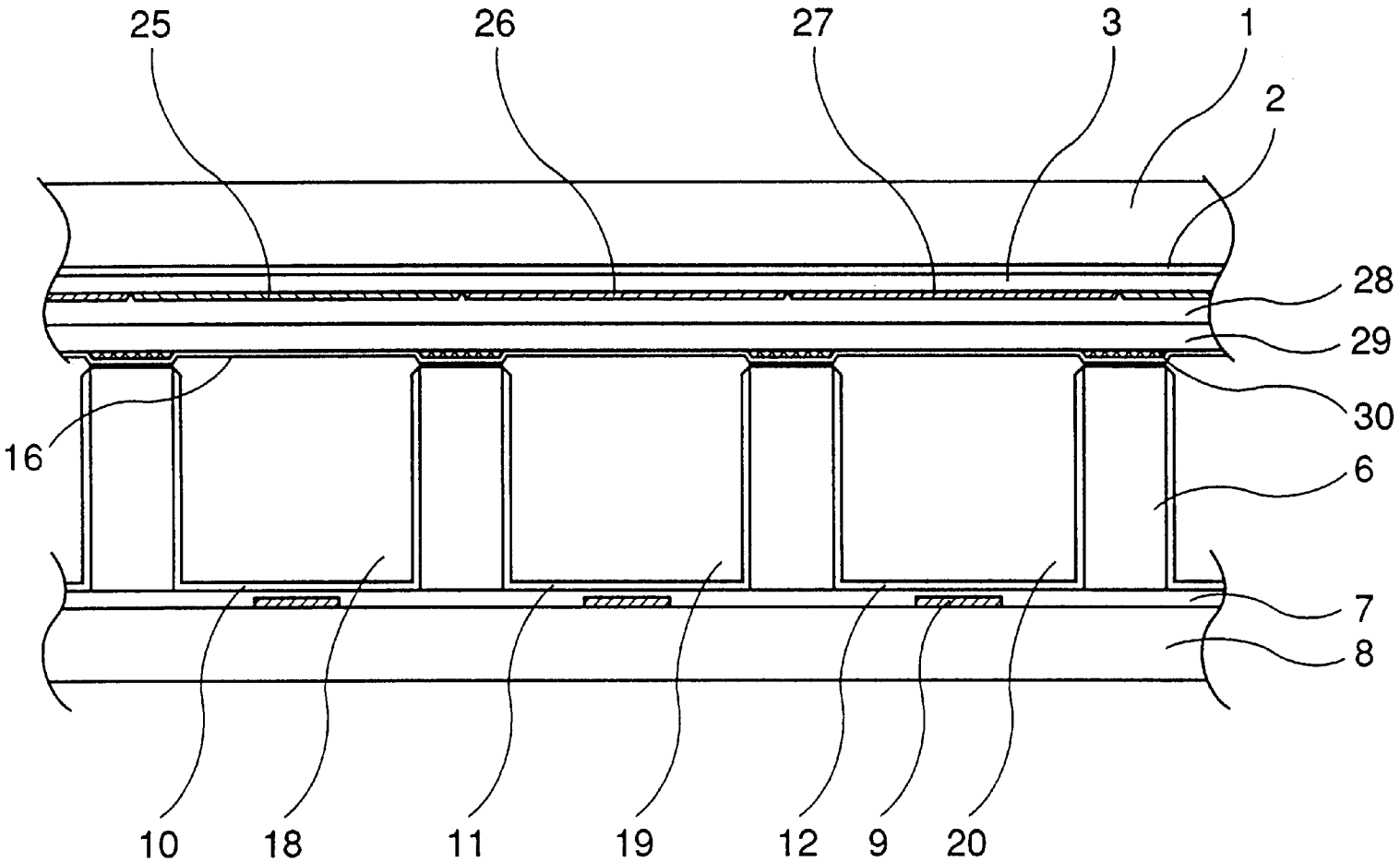
FIG. 10 is a sectional view of the panel structure of a color plasma display panel according to second and third embodiments of the present invention.

As a third embodiment, FIG. 10 shows an example by first forming a buffer layer 3, which is a transparent insulating layer, on an electrode, forming a fine pigment particle layer, and then forming a transparent insulating layer. A front substrate 1, a glass plate, is formed with transparent electrodes 2 thereon, and then with a metal bus electrode (omitted in FIG. 10) thereon. Then, paste of low melting point lead glass is applied, dried and fired on the entire surface to coat the transparent electrodes and the metal electrode with the buffer layer 3 which is a transparent insulating layer. The buffer layer 3 serves as an underlying layer when subsequently forming a fine pigment particle layer. After formation of the buffer layer, respective color fine pigment particle layers are formed in a manner similar to the second embodiment. That is, it is repeated for each of three colors a process to screen print and dry paste which is prepared by mixing fine pigment particles in binder and solvent in stripes with a pitch of 1.05 mm and a width of about 340 microns, so that fine pigment particle layers 25, 26 and 27 patterned for the entire surface are formed. A first insulating layer 28 and a second insulating layer 29 are formed by again applying through screen printing, drying and firing paste of low melting point glass twice thereon. Here, the buffer layer 3 formed as the underlying layer prior to the fine pigment particle layer has a softening point of 520° C., and is fired at 570° C. to cause it to reflow sufficiently. The same material with the softening point of 520° C. is used for the first insulating layer 28 which is formed to directly coat the fine pigment particle layer, but it is fired at a firing temperature of 535° C. so that it is fired in a state where the material is not caused to flow so much. Paste of low melting point glass with a low softening point of 490° C. is used for the second insulating layer 29 which is formed on the first insulating layer 28. However, the firing temperature is arranged to be a higher temperature of 570° C. In such a manner, it is possible to obtain an insulating layer with sufficiently high dielectric strength and good surface flatness as in the second embodiment, and to avoid deterioration of the color filter characteristics due to the formation of the insulating layer.

One of major difference between this embodiment and the second embodiment lies in that an insulating layer serving as an underlying layer is formed prior to the formation of the fine pigment particle layer. Advantages of this processing first include improvement of uniformity. In the case of the second embodiment, since the fine pigment particle layer coats three types of compositions (a glass plate, a transparent conductive film of ITO or tin oxide, and a metal film of the bus electrode), there may arise uneven print thickness, or unevenness because reaction or aggregation is caused in the firing process depending on the combination of the underlying materials and the pigment materials. In particular, this tends to occur in the red or blue pigment. When it is arranged to coat the glass plate section, the transparent electrode section, and the metal electrode section with the buffer layer 3 serving as the underlying layer, these problems do not occur, and a good color filter layer can be obtained. The buffer layer 3 serving as the underlying layer exhibits sufficient effect even when it is as thin as about 3 microns. Of course, it may have a thickness of 20 microns or more to attain sufficiently high dielectric strength. In such a case, it may be possible to omit the insulating layer 29 of the second embodiment so that the buffer layer serving as the underlying layer bears substantial dielectric strength.

FIG. 10 shows an example where thin black matrixes 30 are formed between each color filter layers before vapor deposition of the protective layer 16 of the MgO film. Since the black matrix 30 can cover the white partition 6 which does not emit light, and any pattern offset between the color pigment layers, it contributes to improve the contrast and uniformity of the display surface.

Here, detailed description is given on reaction which occurs in the firing process from combination of the pigment material and the underlying material when the pigment layer is formed. In this case, the underlying material in question includes tin oxide or ITO (indium tin oxide) as the material for the transparent electrode. The reaction may occur when the fine pigment powder layer is formed, but particularly tends to occur when the paste, a mixture of the pigment powder and the low melting point lead glass is printed and dried on the transparent electrode. In the following, detailed description is given on a case where the pigment powder is mixed with the low melting point lead glass, and printed, dried and fired.

Figure 1:
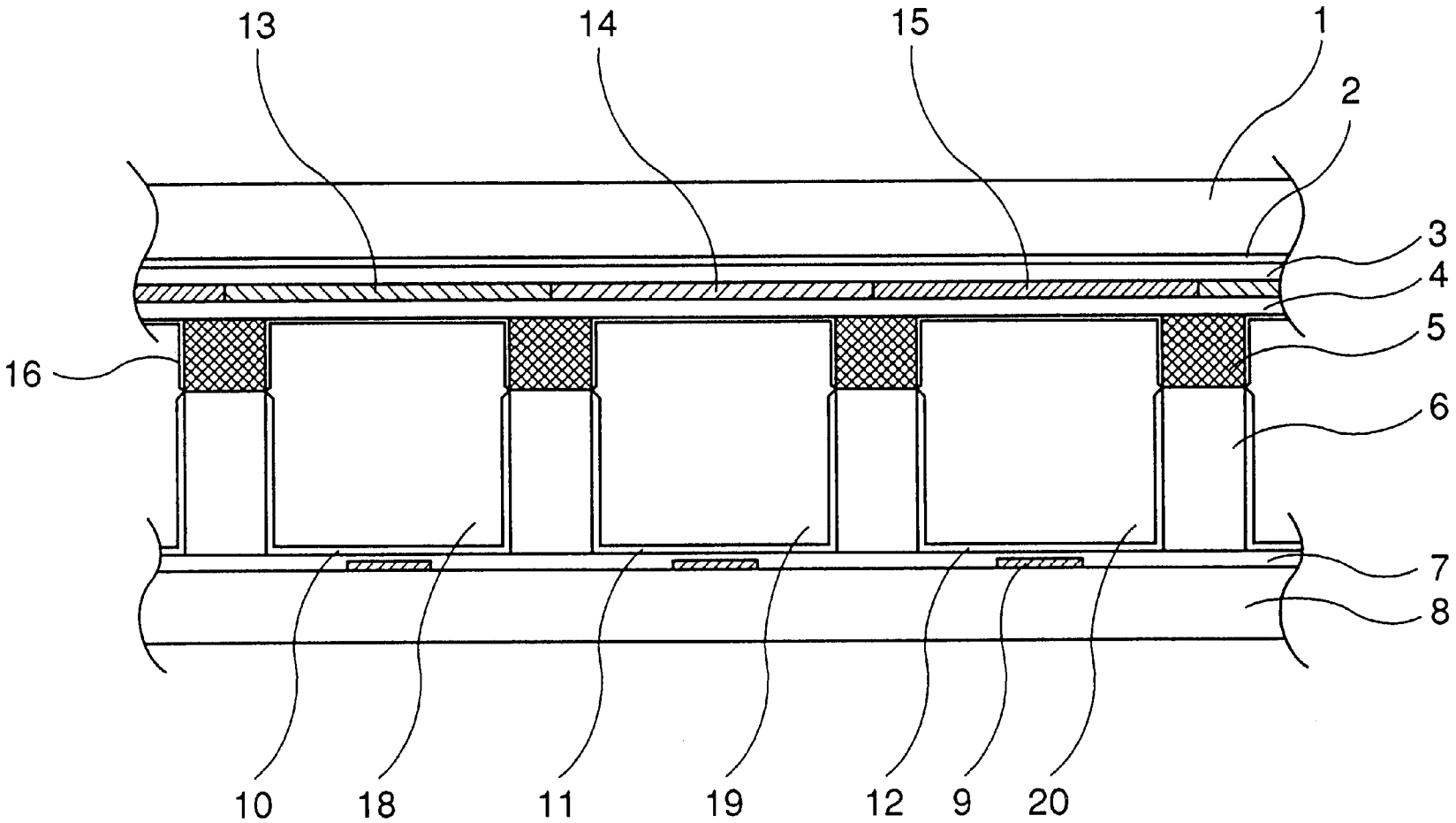
FIG. 1 is a sectional view of the panel structure of a color plasma display panel according to a third embodiment of the present invention.

FIG. 1 shows another example of the third embodiment of the present invention. A conventional example corresponding to FIG. 1 is FIG. 7 in which the same components are identified by the same references.

The AC type color plasma display panel of FIG. 1 differs from the conventional AC type color plasma display panel in the structure of insulating layer coating the transparent electrode 2. That is, the AC type color plasma display panel of FIG. 1 forms the buffer layer 3 on the transparent electrode 2, on which the color filter (red) 13, the color filter (green) 14 and the color filter (blue) 15 are formed in correspondence to the discharge cell (red) 18, the discharge cell (green) 19, and the discharge cell (blue) 20, and on which the transparent insulating layer 4 is coated.

In this case, the color filter (red) 13, the color filter (green) 14 and the color filter (blue) 15 are formed by screen printing, drying and firing each color filter paste which is prepared by typically mixing a mixture of the low melting point lead glass powder and the pigment powder in organic solvent and binder. The material of pigment powder may be same as those described for the above embodiments. Accordingly, the pigment powder is in a form where it is dispersed in the insulating layer of low melting point lead glass, so that the fine pigment particle layer (red) 25, the fine pigment particle layer (green) 26 and the fine pigment particle layer (blue) 27 are entirely separated and also identified by different references.

Since this structure has the buffer layer 3, the transparent electrode 2 never directly contacts the color filters 13, 14 and 15. Accordingly, it is possible to prevent reaction between tin oxide ($SnO_2$) or ITO which is the material for the transparent electrode 2 and the inorganic pigment which is the main component of the color filter.

On the other hand, if a color filter is formed directly on the transparent electrode 2 without using the buffer layer 3, tin oxide ($SnO_2$) or ITO in the transparent electrode 2 reacts the inorganic pigment which is the main component of the color filter. Detailed mechanisms are not yet clarified for such reaction. It is described how the transmission spectrum of the color filter is varied by such reaction.

Figure 3:
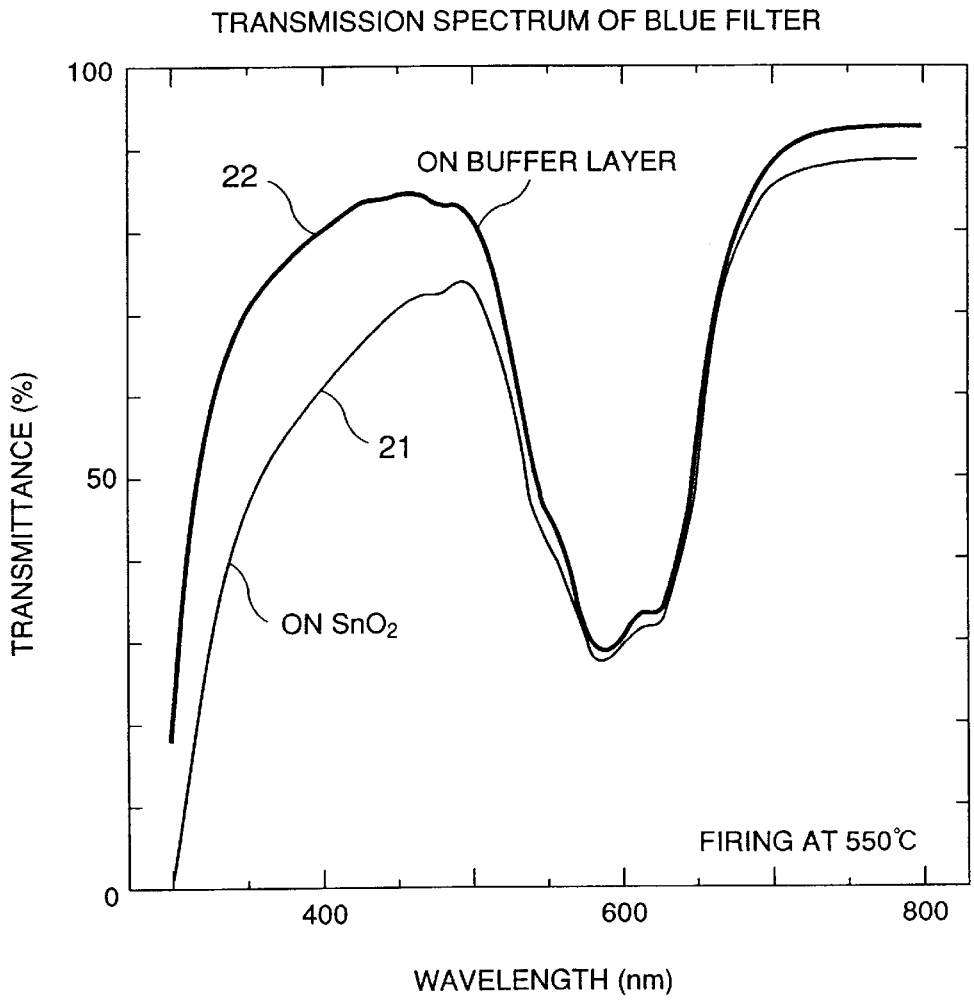
FIG. 3 is a graph showing changes of transmission spectrum of a blue color filter.

In the graph of FIG. 3, reference numeral 21 indicates the curve of transmission spectrum when the color filter (blue) 15 using a blue pigment is fired on tin oxide ($SnO_2$) according to the prior art, while reference numeral 22 indicates the curve of transmission spectrum when the color filter using the blue pigment is fired on the buffer layer 3 of low melting point lead glass according to the embodiment of the present invention. The color filter paste is fired at a temperature of 550° C.

When the curves 21 and 22 are compared, it is found that light with wavelength near 400 nm is more strongly absorbed in the curve 21.

Since the light emitted from a blue phosphor is a wavelength near 455 nm, it is affected by the above absorption. Then, when the blue filter is formed on $SnO_2$, the transmission spectrum is significantly reduced. FIG. 3 shows the change of transmissivity in such a case, wherein the substantially same change is also observed when the color filter is fired on ITO.

Figure 4:
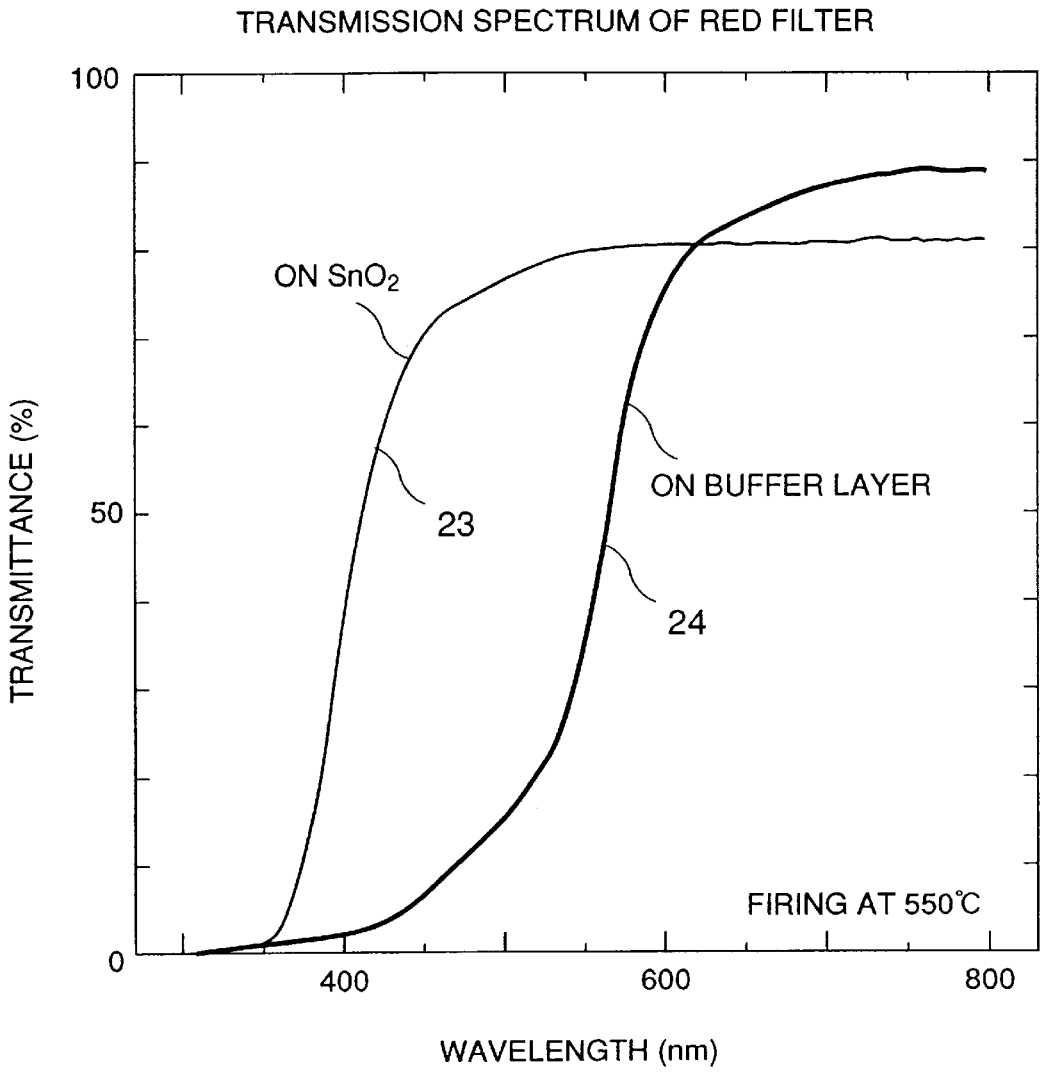
FIG. 4 is a graph showing changes of transmission spectrum of a red color filter.
Figure 5:
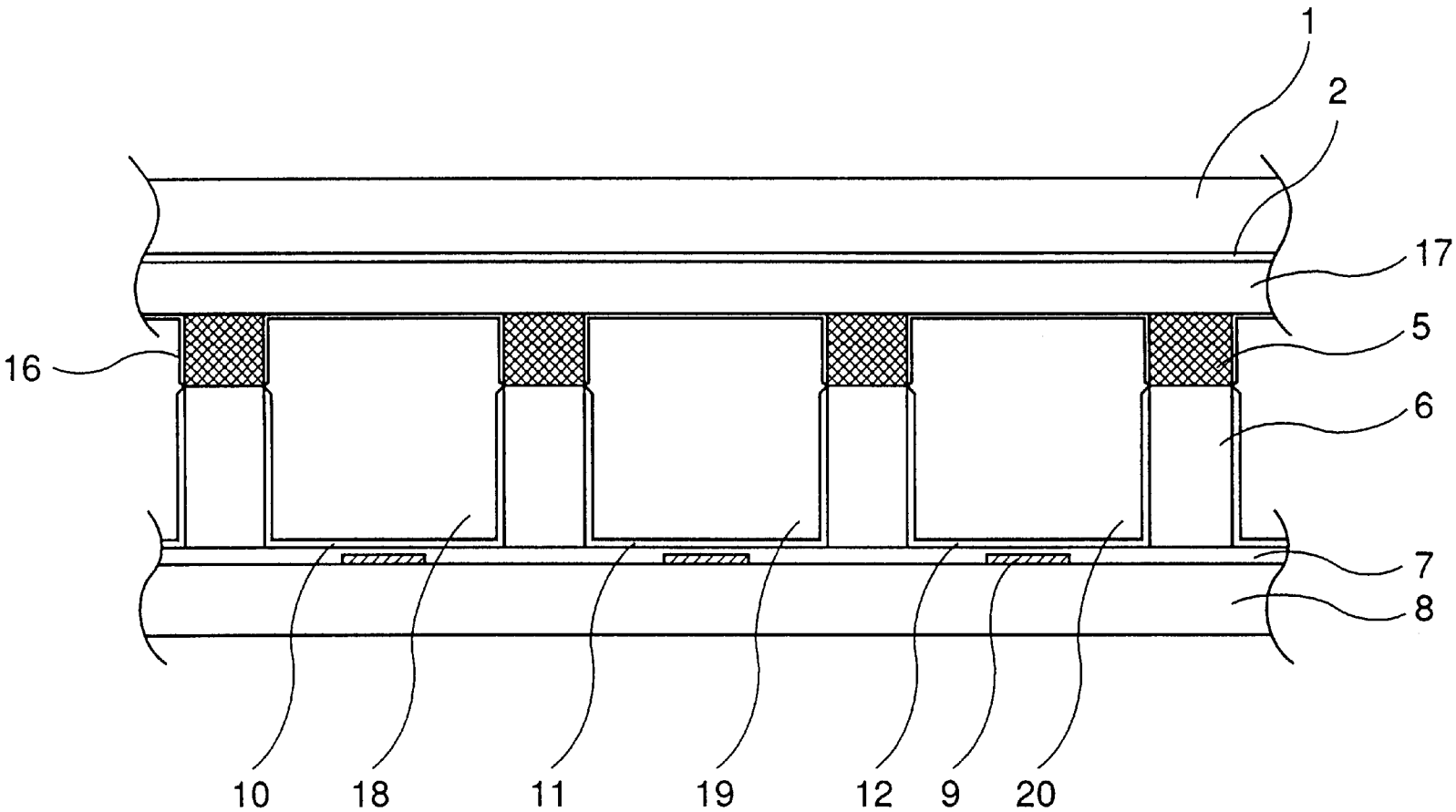
Fig.5 PRIOR ART
FIG. 5 is a sectional view of a conventional color plasma display panel.
Figure 6:
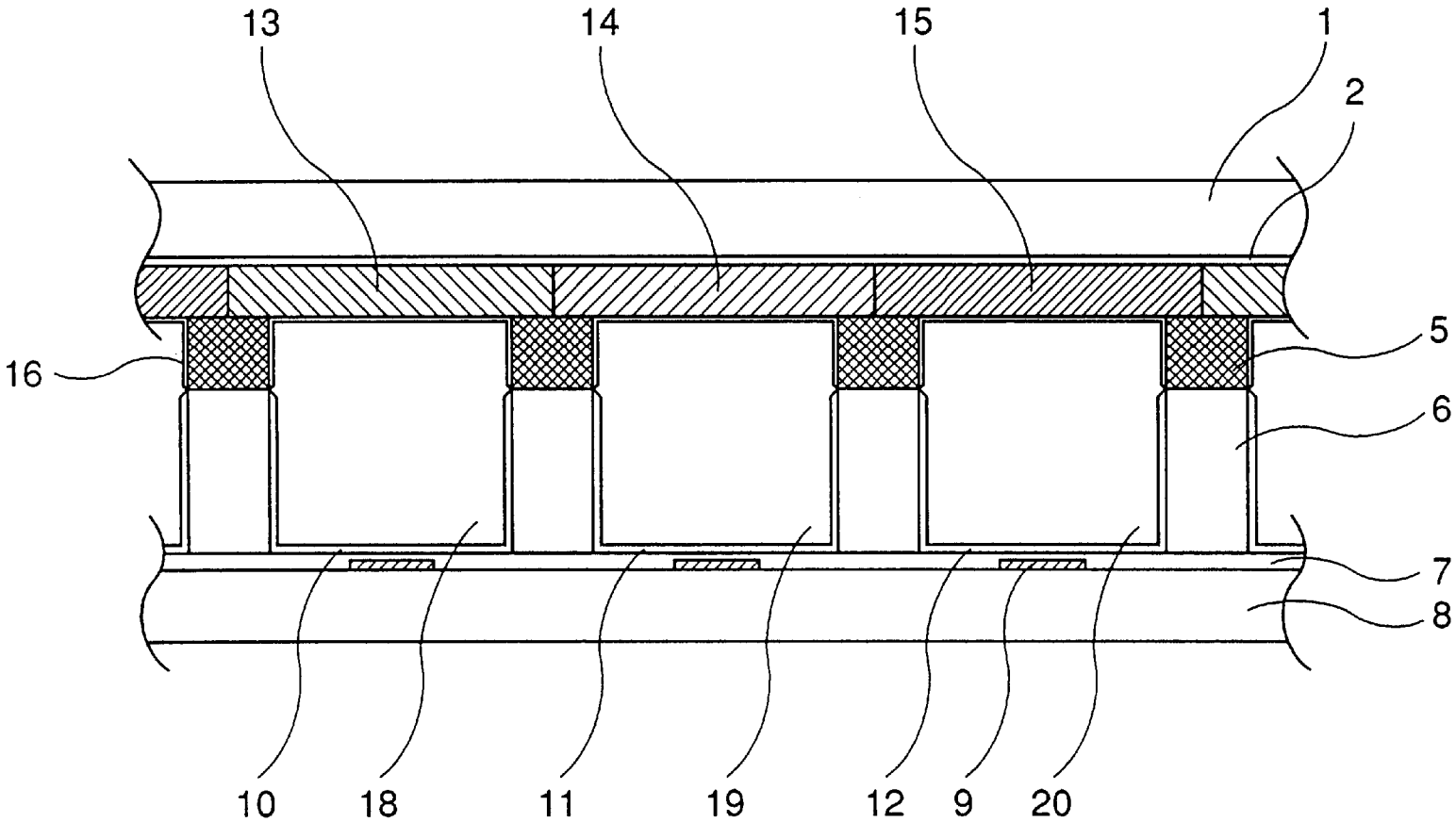
Fig.6 PRIOR ART
FIG. 6 is a sectional view of a conventional color plasma display panel.

In FIG. 4, a curve 23 shows the transmission spectrum when the color filter (red) 13 using a red pigment is fired on tin oxide ($SnO_2$) according to the prior art, while a curve 24 shows the transmission spectrum when red filter paste is fired on the buffer layer 3 of low melting point lead glass according to the embodiment of the present invention. Again, the color filter paste is fired at a temperature of 550° C.

The light emitted from a red phosphor has a wavelength near 610 nm. As seen from the curve 24, when the color filter using the red pigment is fired on the buffer layer, the transmittance is reduced at the region of wavelength shorter than 610 nm, so that it attains the function as the color filter. However, when the color filter using the red pigment is fired on the tin oxide ($SnO_2$), significant discoloring is observed as indicated by the curve 23, so that the transmittance changes little to a region near 400 nm, and it cannot attain the function as the filter. FIG. 4 shows changes of the transmittance for a transparent electrode of tin oxide ($SnO_2$). Substantially the same change is observed on ITO.

As for the green color filter, no change is observed for the transmission spectrum even when it is fired on the transparent electrode.

In other words, the color plasma display panel of FIG. 1 prevents the reaction between tin oxide ($SnO_2$) or ITO which is the material for the transparent electrode 2 and the inorganic pigment which is the main component of the color filter, and thus the change of transmittance by forming the buffer layer 3 on the transparent electrode 2 so that the transparent electrode 2 never directly contacts the color filters 13 ,14 and 15.

This embodiment is arranged on the basis of completely new finding that the transmission spectrum is changed for a color filter directly formed on the transparent electrode.

Figure 2:
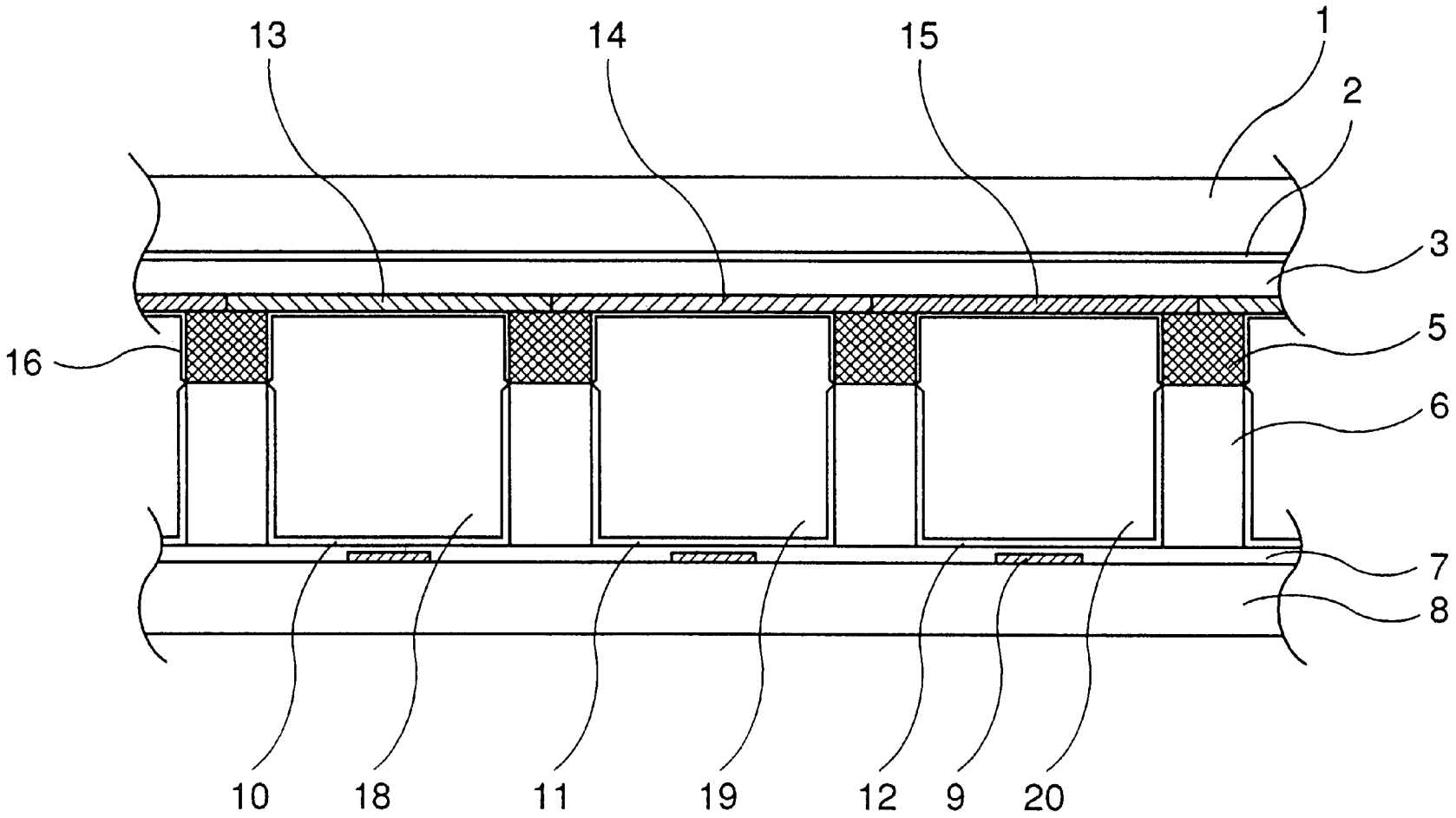
FIG. 2 is a sectional view of the panel structure of a color plasma display panel according to the third embodiment of the present invention.

FIG. 2 shows a sectional view of another example of the AC type color plasma display panel according to this embodiment.

Figure 7:
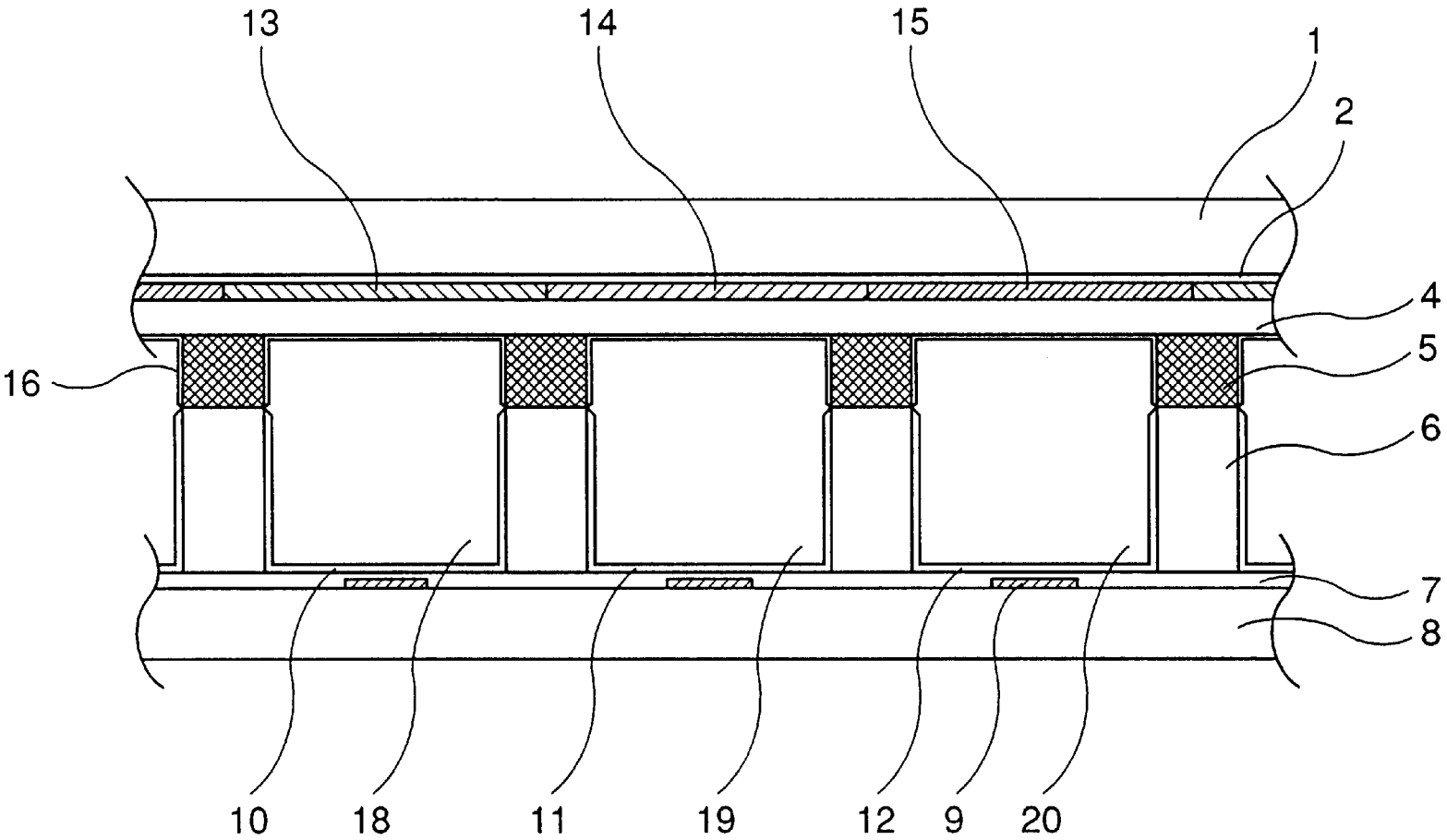
Fig.7 PRIOR ART
FIG. 7 is a sectional view of a conventional color plasma display panel.

This color plasma display panel has a basic structure similar to that of the conventional AC type color plasma display panel shown in FIG. 7. However, it differs in that the transparent insulating layer 4 for smoothing the surface of the color filter layers 13, 14 and 15 is removed, and the buffer layer 3 is inserted between the transparent electrode 2 and the color filter layers 13, 14 and 15 in which pigment powder is dispersed in low melting point lead glass. In this case also, there is no change of transmissivity because the transparent electrode 2 never directly contacts the color filter layers 13–15.

The color filter layer of the embodiment described here is constituted by printing a mixture of pigment and low melting point lead glass according to this embodiment. As described above, a similar effect can be obtained by previously printing only pigment powder, and then coating and firing it with transparent low melting point lead glass. In addition, a similar effect can be obtained by mixing a photosensitive material in pigment powder, forming a color filter layer with the photolithography, and coating and firing it with low melting point lead glass.

Low melting point lead glass is best suitable for the material of the buffer layer 3 shown in FIGS. 1, 2 and 10. In addition to the above, however, the buffer layer 3 may be formed in a thickness of about 1–3 $\mu$m by vacuum depositing, for example, alumina. This also provides a sufficient effect of the buffer layer.

Still another materials include $SiO_2$. It is possible to form the buffer layer by spattering or dipping $SiO_2$. Many other materials often provide a similar effect.

That is, it can be expected to obtain a substantially equivalent effect to the buffer layer of low melting point lead glass. However, the buffer layer of low melting point lead glass can be said to be best when taking conformity with the process or cost.

[Fourth Embodiment]

The second embodiment constitutes the insulating layer consisting of low melting point lead glass in a two-layer structure with different softening points. However, it is possible to provide control only with firing conditions although the margin is limited in the manufacturing process. It is described in the following as a fourth embodiment. The figure to be referred to is FIG. 9 as in the second embodiment. After the color filter layers (fine pigment particle layers 25, 26 and 27) are formed by red, green and blue pigment particles in a similar manner to the second embodiment, a first insulating layer 28 is formed in a thickness of about 8 microns by printing, drying and firing at 500° C. paste containing low melting point lead glass powder with a softening point of 470° C. as its main component. Then, a second insulating layer 29 is formed again by printing, drying and firing at 550° C. paste of the same low melting point lead glass. As described, when the insulating layer coating the fine pigment particle layer is divided into two layers, and the first glass layer coating the fine pigment particle layer is once fired at a lower temperature, even if the low melting point lead glass paste printed again is fired at a higher temperature, it is possible to avoid influence to the fine pigment particle layer. Of course, if the firing temperature is too high, the fine pigment particle layer suffers from pattern deformation due to diffusion, aggregation, cracking or flowing. If the firing temperature is too low, there arises a problem such as lowering of dielectric strength or remaining of air bubbles. However, a color filter with good characteristics can be obtained by separately firing two insulating layers at different firing temperature although the process margin is limited when compared with the second embodiment. In this case, a plurality of insulating layers can be formed through printing of the same paste, so that the process cost can be lowered. In addition, this approach can be applied to the structure of the third embodiment.

To attain a good panel in which the fine pigment particle layer is coated with insulating layers, it is preferable that the difference between the first firing temperature for the insulating layer directly coating the fine pigment particle layer and the second higher firing temperature is about 20° C. to 30° C. although the optimum firing temperature differs depending on the low melting point lead glass material used for the insulating layer.

Figure 11:
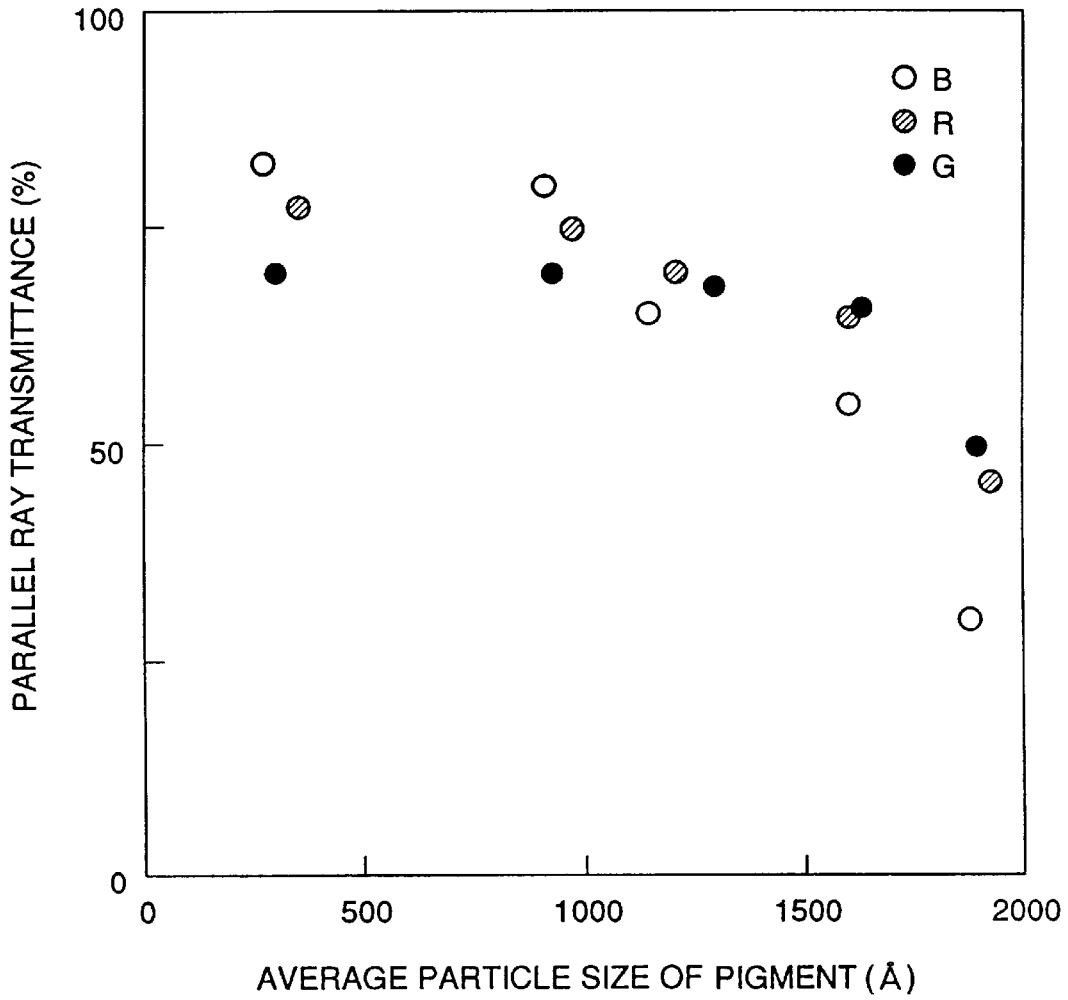
FIG. 11 is a graph showing the relationship between average particle size of a pigment and parallel ray transmittance.
Figure 12:
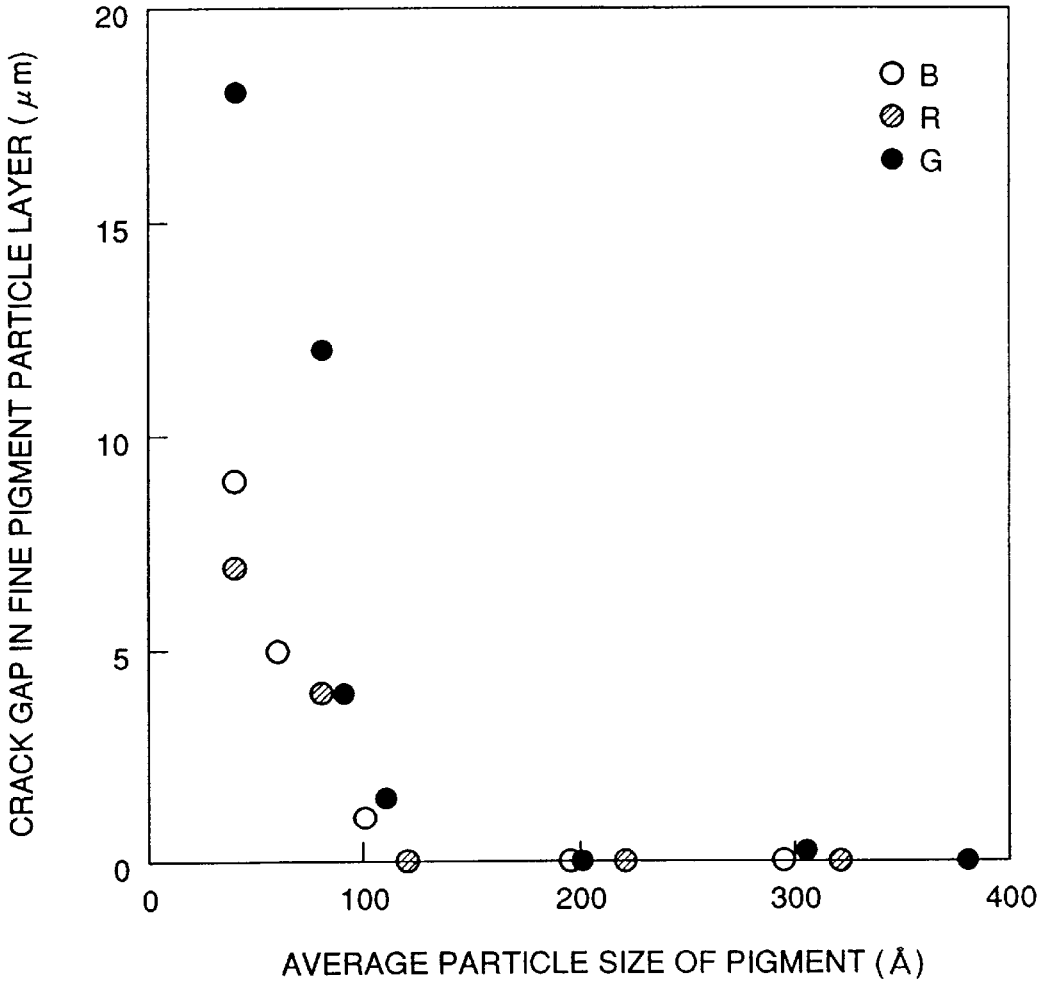
FIG. 12 is a graph showing the relationship between average particle size and crack gaps in the fine pigment powder layer.

The characteristics of color filter is significantly affected by the average particle size of fine pigment particles used for the above-mentioned first to fourth embodiments and the film thickness of the fine pigment particle layer. The average particle size of pigment particles relates to cracking in the fine pigment particle layer during firing the insulating layer and the transmission spectrum. It is found that the average particle size of 0.01–0.15 microns can provide a color filter free from cracking and with excellent selective transmission characteristics. As shown in FIG. 11, as the average particle size increases, scattered light increases from about 0.15 microns, and parallel ray transmittance decreases. Thus, since the display surface becomes opaque due to decrease of transmittance of the color filter and scattered external light as the average particle size increases, the contrast is reduced. On the other hand, when the average particle size becomes 0.01 microns or less, cracking tends to occur in the fine pigment particle layer perhaps due to increase of aggregation. FIG. 12 shows an example of it. Crack gap in the fine pigment particle layer on the ordinate axis means a width of gap in cracks generated in the fine pigment particle layer. If such crack exists, there arises a problem that amount of white transmitted light increases, and the selective transmission characteristics of the color filter decreases. In view of the above, this embodiment mainly uses fine pigment particles with average particle size of 0.03 microns which is within the optimum average particle size range of fine pigment particles described above.

Figure 13:
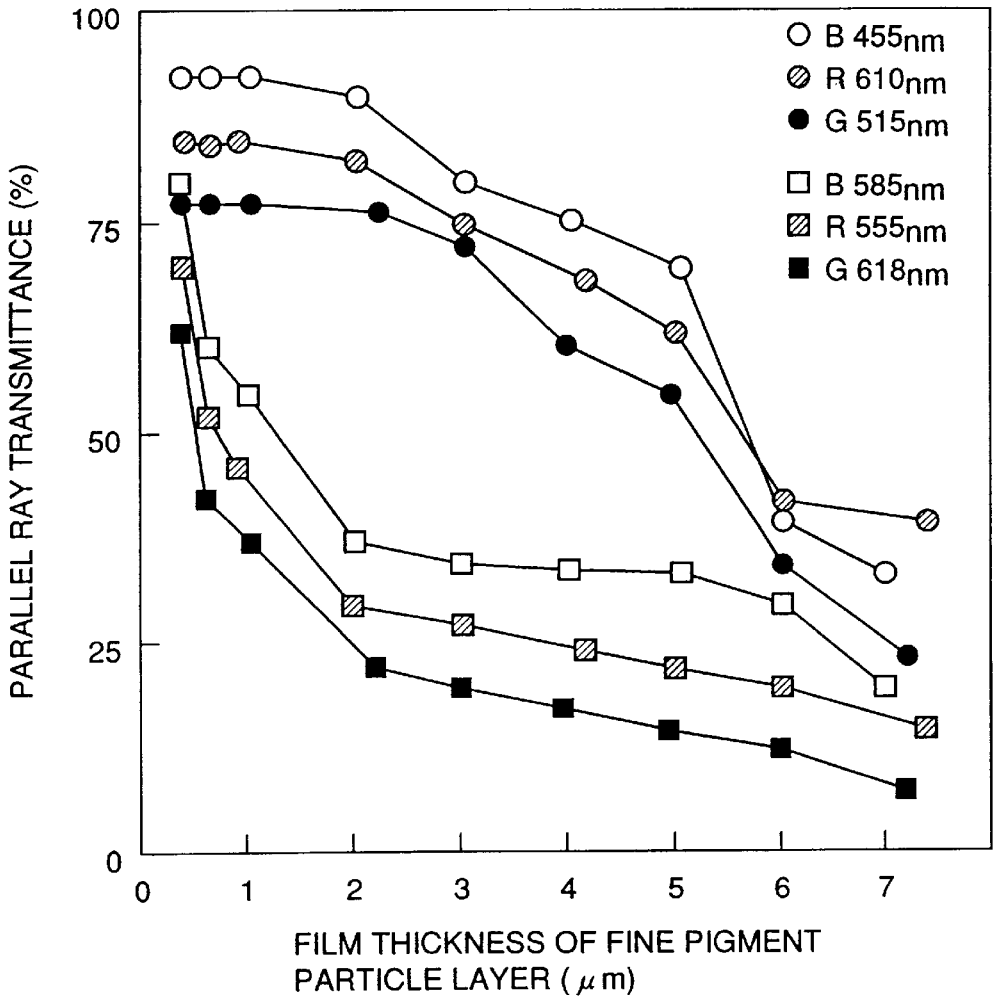
FIG. 13 is a graph showing the relationship between a film thickness of fine pigment particles and parallel ray transmittance.

FIG. 13 shows film thickness dependence of parallel ray transmittance of the fine pigment particle layer. The characteristics of FIG. 13 are obtained by plotting transmittance at wavelength of 610 nm, 515 nm and 455 nm which are peaks red, green and blue phosphors, and transmittance at absorption peaks of 555 nm, 618 nm and 585 nm of the color filters. However, since the red filter has transmission spectrum like an edge filter, 555 nm is determined to be the wavelength of absorption peak.

Color filter characteristics capable of providing a higher contrast are that there is a large difference in FIG. 13 between circular plots representing the wavelength of light emitted from the phosphors and square plots representing absorption wavelength of filters. That is, it is necessary to have characteristics selectively transmitting emitted light of red, green and blue, and shielding light with other wavelength. It is found from FIG. 13 that, when the fine pigment particle layer is too thick, since the transmittance decreases as a whole, there is transmission characteristics where there is no difference between the circular and square plots. It can be determined from such fact that the optimum film thickness range for the fine pigment particle layer is 5 $\mu$m or less.

In addition, when the pigment particle layer is too thin, wavelength dependence of the transmission spectrum becomes weak so that the spectrum has a gentle slope as a whole and the selective transmission characteristics are lost. This is because, as the ratio of pigment particles in the pigment paste is extremely reduced, the optical density as the color filter is reduced, and dispersion is significantly degraded by the cohesive force between the fine pigment particles, thereby amount of white transmitted light being increased. It can be determined from such fact that the optimum film thickness range for the fine pigment particle layer is 0.5 $\mu$m or more.

Thus, it can be determined from the above facts that the optimum film thickness range for the fine pigment particle layer to obtain color filter characteristics for high contrast is in a range of 0.5–5 $\mu$m. However, as can be seen from FIG. 13, it is obvious that the transmittance at wavelength of light emitted from the phosphor begins to decrease when the film thickness of the fine pigment particle layer exceeds 3 microns. It can be said from the viewpoint placing emphasis on luminous brightness that the film thickness of fine pigment particle layer is more preferably in a range of 5 microns to 3 microns.

In addition, while the low melting point lead glass used for the insulating layer has a relatively high dielectric constant of about 13, the dielectric constant of pigment particle is small in many cases when compared with low melting point lead glass. Furthermore, substantial dielectric constant is further reduced perhaps due to the fact that very small gaps remain between the particles in the fine pigment particle layer. Thus, discharge voltage tends to rise when the fine pigment particle layer is inserted. When it is very thin, the rise of discharge voltage is negligible. However, when the fine pigment particle layer has a thickness of 5 microns or more, the discharge voltage rises by as much as 10 V or more, which is disadvantageous also in driving the panel. This embodiment is arranged that each of the red, green and blue color filter layers has a film thickness of 1–2 microns in the optimum film thickness range.

The optimum film thickness can be applied not only to the plasma display panel in the AC type structure in which the fine pigment particle layer is coated with low melting point lead glass, but also to a plasma display panel in a structure in which a fine pigment particle layer directly exposes within a discharge space.

While the above embodiments show examples in which the color filter layers are constituted by fine pigment particle layers for all three colors of red, green and blue, the fine pigment particle layer according to the present invention may be formed for two or only one color for simplification of the process or balance of emitted light color.

In addition, while the above embodiments are described on a panel of an AC surface discharge type structure, it is a matter of course that the present invention can be applied to an AC plasma display of opposed two-electrode type in the exactly same manner.

Deterioration by reaction can be reduced by using a thin layer containing fine pigment particles with very fine particle size as a color filter, instead of dispersing conventional color pigment powder in an insulating layer of glass even in the firing process at a high temperature. This is because the fine pigment particles are in a very dense layer state, so that the amount contacting and reacting with the glass material is low as a whole. When the fine pigment particles are fired in contact with the insulating layer of low melting point lead glass, mutual penetration occurs because the low melting point lead glass is softened. However, since the pigment particles are very, fine, they are relatively strongly attached, so that the small quantity of fine pigment particles diffuses into the low melting point lead glass layer. In addition, since gaps are very small between the fine pigment particles, the amount of glass material is also very small for reversely penetrating into the pigment layer. Thus, even if the same fine pigment particles are used, it is possible to obtain a color filter with little scattering due to the difference of refraction indexes and good transmissivity when compared with the case where the pigment particles are dispersed into the glass layer. In addition, when the insulating layer contacting the color filter layer is made of a material with a high softening point, the above reaction and mutual penetration are more effectively prevented, and it is possible to reduce fluidized deformation due to reflow, aggregation of pigment particles, and cracking in the pigment layer, whereby a color filter with uniform and fine pattern can be attained.

As described, by employing a panel incorporating the fine pigment particle layer of the present invention, it is possible to attain a color plasma display panel for which reflection of external light is suppressed, and which has a high contrast even in a bright place. In addition, since visible light emitted from the discharge gas or unnecessary light emitted from the phosphor can be effectively shielded, the color purity can be also effectively improved. The fine pigment particle layer can be easily formed in a process added to the process for forming the insulating layer in manufacturing the front substrate of an AC type plasma display panel, and requires not so much cost in forming the color filter layer, so that it can be easily employed in the industrial use.

What is claimed is:

1. An AC color plasma display panel comprising transparent electrodes coated by a first insulating layer, said first insulating layer having a multi-layered structure comprising a buffer layer directly coating said transparent electrodes, and a color filter insulating layer formed on the buffer layer.

2. The color plasma display panel as claimed in claim 1, wherein said buffer layer consists of low melting point lead glass.

3. The color plasma display panel as claimed in claim 1, wherein said buffer layer consists of alumina.

4. The color plasma display panel as claimed in claim 1, wherein said buffer layer consists of silicon dioxide.

5. The color plasma display panel as claimed in claim 1, wherein said transparent electrodes consist of tin dioxide.

6. The color plasma display panel as claimed in claim 1, wherein said transparent electrodes consist of indium tin dioxide.

7. The color plasma display panel as claimed in claim 1, wherein said color filter insulating layer is a printed mixture of low melting point lead glass and pigment powder.

8. The color plasma display panel as claimed in claim 1, wherein said color filter insulating layer comprises a pigment powder and a transparent low melting point lead glass thereon.

9. The color plasma display panel as claimed in claim 1, wherein said color filter insulating layer is a mixture of pigment powder and a photosensitive material, having transparent low melting point lead glass thereon.

10. An AC type color plasma display panel comprising at least discharge electrodes and an insulating layer on a front surface which serves a display surface, wherein a thin color filter layer is formed in contact with or within said insulating layer, said color filter layer containing fine pigment particles as its main component.

11. The color plasma display panel as claimed in claim 10, wherein a thin color filter layer is formed on said insulating layer, said color filter layer containing fine pigment particles as its main component.

12. The color plasma display panel as claimed in claim 10, wherein after said thin color filter layer is formed on the substrate containing the discharge electrodes, said insulating layer is formed to coat the color filter layer, the color filter layer containing fine pigment particles as its main component.

13. The color plasma display panel as claimed in claim 10, wherein after said insulating layer is formed on the substrate containing the discharge electrodes, said thin color filter layer is formed, said color filter layer containing fine pigment particles as its main component, said insulating layer being formed to coat the color filter layer.

14. The color plasma display panel as claimed in claim 10, wherein said insulating layer consists of at least two layers of insulating layer constituting materials, the softening point of the insulating layer constituting material contacting at least one surface of the thin color filter layer containing fine pigment particles as its main component being higher than the softening point of the constituting material in at least one layer in the other insulating layer constituting material.

15. The color plasma display panel as claimed in any one of claims 10 through 14, wherein said thin color filter layer containing fine pigment particles as its main component has a thickness of 0.5–5 microns.

16. The color plasma display panel as claimed in any one of claims 10 through 14, wherein said thin color filter layer containing fine pigment particles as its main component has a thickness of 0.5–3 microns.

17. The color plasma display panel as claimed in any one of claims 10 through 14, wherein said thin color filter layer containing fine pigment particles as its main component is made of pigment powder the average particle size of which is 0.01–0.15 microns.

18. An AC color plasma display panel, comprising:

a substrate;

transparent electrodes formed on said substrate;

a first insulation layer formed on said transparent electrodes; and a second insulation layer forming a color filter, said second insulation layer formed on said first insulation layer.

* * * * *